United States Patent [19]

Carter

[11] 4,018,379

[45] Apr. 19, 1977

[54] MAILBOX SIGNAL DEVICE

[76] Inventor: Lewis D. Carter, 4990 Central Ave., McKinleyville, Calif. 95521

[22] Filed: Mar. 23, 1976

[21] Appl. No.: 669,511

[52] U.S. Cl. ..... 232/35

[51] Int. Cl.[2] ..... B65D 91/00

[58] Field of Search ..... 232/34, 35

[56] References Cited

UNITED STATES PATENTS

| | | | |
|---|---|---|---|
| 745,749 | 12/1903 | Wheeler | 232/34 |
| 968,151 | 8/1910 | Harmon | 232/34 |
| 1,128,919 | 2/1915 | Utterback | 232/35 X |
| 1,799,861 | 4/1931 | Muzzio | 292/281 |
| 2,636,669 | 4/1953 | Mossman, Sr. | 232/35 |
| 3,080,107 | 3/1963 | Lindahl | 232/35 |
| 3,559,878 | 2/1971 | Roeder | 232/35 |

*Primary Examiner*—Roy D. Frazier
*Assistant Examiner*—Peter A. Aschenbrenner
*Attorney, Agent, or Firm*—Melvin R. Stidham

[57] ABSTRACT

A signal device for a mailbox of the type having a pair of forwardly protruding, engageable latch straps on the box and door. A signal device comprises a plate having a slot near the lower edge thereof that slips over the latch strap on the box to be pivotable thereon. When the door is closed with the plate held erect, it engages depending portions of the plate to hold it erect. Opening the door releases the plate and allows it to fall.

5 Claims, 3 Drawing Figures

MAILBOX SIGNAL DEVICE

BACKGROUND OF THE INVENTION

Rural mailboxes are often located a considerable distance from the residence of the owner and, normally, the owner has to walk to the mailbox, even in inclement weather, just to see if a delivery has been made. Various signal devices have been devised, but they generally require that the mail deliverer manipulate some device in order to activate a signal. Hence, such devices are subject to human failure and cannot, therefore, be deemed wholly reliable.

OBJECTS OF THE INVENTION

It is an object of this invention to provide a simple signaling device for a mailbox which is inexpensive and easy to install.

It is further object of this invention to provide a signal device for a mailbox which requires no particular manipulation by the mail deliverer.

It is a further object of this invention to provide a signaling device for a mailbox which operates automatically when the mailbox is opened.

Other objects and advantages of this invention will become apparent from the description to follow when read in conjunction with the accompanying drawings.

BRIEF SUMMARY OF THE INVENTION

In carrying out this invention, I provide a generally rectangular plate that has a slot adjacent to the lower edge thereof enabling it to be received on the forwardly protruding latch strap of the mailbox. When the plate is held erect, depending portions thereon, which straddle the strap, are engageable by the door of the mailbox. Hence, the plate may be held upright and the door closed to hold the plate upright until the door is again opened.

The plate may be provided with rearwardly extending panels on its side edges which position the center of gravity of the device rearward of the plane of the plate to insure that the plate will fall when the mailbox door is opened, even though the box may be inclined forwardly. Suitable blocking means may be provided on the latch strap of the box to block removal of the signal device.

DESCRIPTION OF A PREFERRED EMBODIMENT

Figure 1:
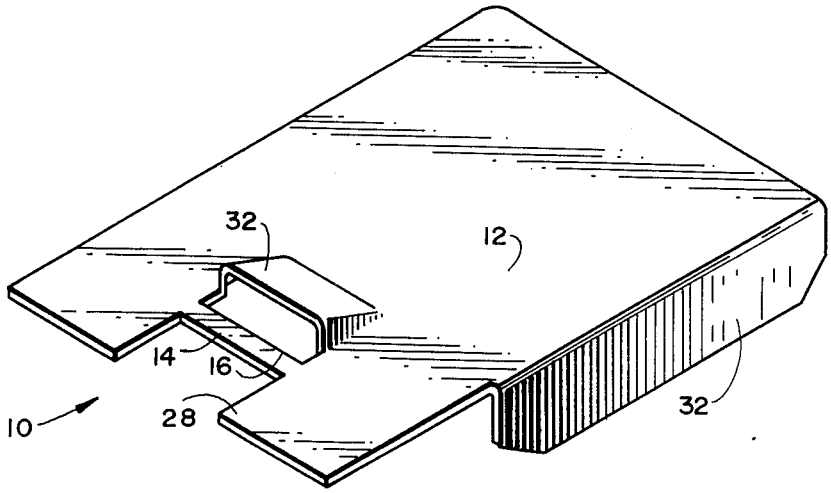
FIG. 1 is a view in perspective of the signal device comprising my invention.

Referring now to the drawings with greater particularity, the signal device 10 comprises a plate 12 of metal, plastic or any suitable material capable of being held upright with out collapsing. Adjacent the lower edge 14 of the plate is a slot 16 of sufficient length and width to fit freely over the conventional, spring metal latch strap 18 which is secured to the top of the mailbox 20 to be engaged by a complemtary latch strap 22 secured to the door 24, which is pivoted at 26 at the front of the box.

Figure 2:
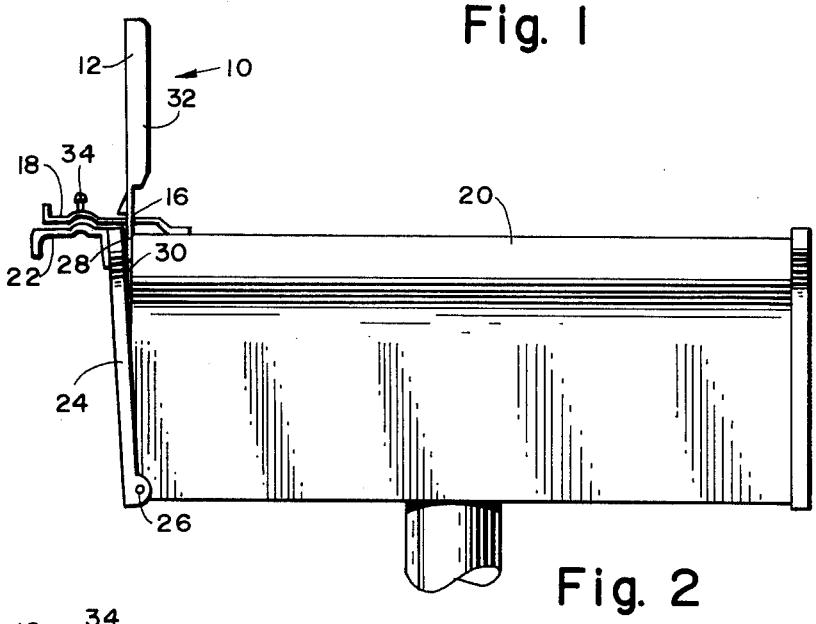
FIG. 2 is a side elevation of a mailbox with the signal device positioned prior to mail delivery.
Figure 3:
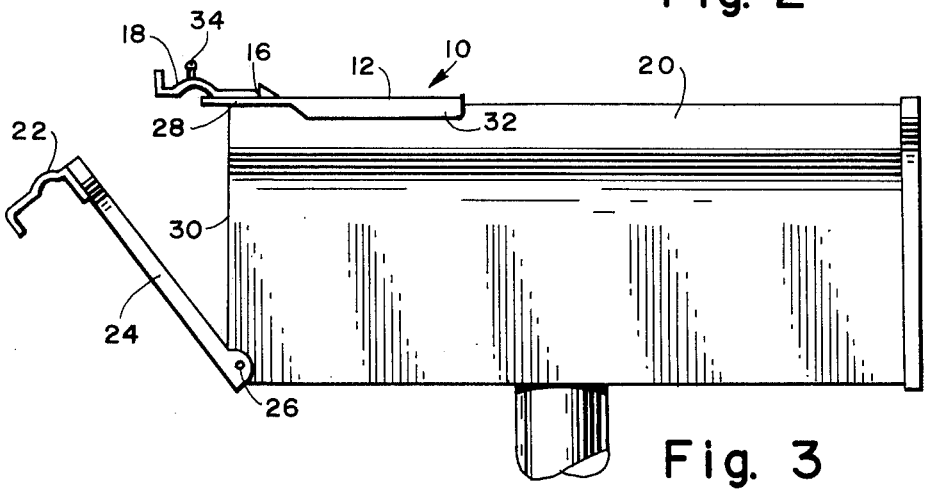
FIG. 3 is a side elevation of the box showing position of the signal device when the door is opened.

Depending portions 28 of the plate on either side of the slot 16 extend below the central bottom edge 14 whereby when the plate is positioned on the box latch strap 18 and held upright, the depending portions will straddle the strap 18 and extend down into the area defined by the mailbox opening 30. Hence, when the mailbox is closed to the position shown in FIG. 2 with the door latch strap 22 engaged by the box latch strap 18, the plate will be held upright by engagement of the door 24 against the depending portions of the plate. This is the position in which the signal device 10 is placed by the owner when he retrieves his mail from the previous delivery.

Then, when the door 24 is opened by the Post Office employee seeking to make another delivery, it releases the depending portions 28 of the plate 12 and allows it to fall by gravity against the upper surface of the mailbox 20. When the delivery is completed, the mail deliverer simply closes the door 24 and allows the signal device 10 to remain in its fallen position.

The depending portions 28 are located to swing freely past the latch strap 18, to insure that they will not be hung up, and the surface of the plate 12 just above the slot 16 is bent forward as shown at 32, to insure free pivotal action of the device 10 and allow it to lie flat against the box 20 free of engagement by the closing door 24, which could otherwise pivot it back to upright position.

In the preferred embodiment of this invention, the plate 12 includes rearwardly depending panels 32 along its side edges, which tend to locate the center off gravity rearward of the plane of the plate 12 to insure that the signal device will fall even though the mailbox is inclined slightly forward.

As an additional feature of my invention, I provide a suitable blocking means 34, such as a screw, which prevents removal of the signal device 10 from the latch strap 18. Holes are normally provided on the latch straps to receive a locking device, but such are rarely used for that purpose. Hence, a small bolt and nut could easily and quickly be installed.

While this invention has been described in conjunction with a preferred embodiment thereof, it is obvious that modifications and changes therein may be made by those skilled in the art without departing from the spirit and scope of this invention, as defined by the claims appended hereto.

What is claimed as invention is:

1. A signal device for a mailbox having a pair of forwardly protruding, engageable latch straps on the box and door, respectively, said signal device comprising:

a plate;

a slot in said plate through along and adjacent the bottom edge thereof adapted to be received freely on the latch strap on said box; and portions of said plate along said bottom edge being adapted when said plate is held upright to be disposed below the upper surface of said box for engagement by said door when said latch straps are engaged;

said portions being disposed laterally of said slot to avoid interference with said box latch strap when said plate pivots downward.

said plate being unsupported and free to pivot downward by gravity when said door is opened.

2. The signal device defined by claim 1 including:

means on said plate to displace the center of gravity rearward of the plane thereof.

3. The signal device defined by claim 2 wherein said last-named means comprises:

a rearwardly extending panel along a side edge of said plate.

4. The signal device defined by claim 1 wherein:

the portion of said plate adjacent the upper edge of said slot is deflected forwardly to enable said plate to lie flat while said slot is engaged over said box latch strap.

5. The signal device defined by claim 1 including:

blocking means on said box latch strap to block removal of said plate therefrom.

* * * * *